United States Patent [19]

Morishita

[11] Patent Number: 4,587,861

[45] Date of Patent: May 13, 1986

[54] INTERNAL SPEED-REDUCTION TYPE STARTER

[75] Inventor: Akira Morishita, Himeji, Japan

[73] Assignee: Mitsubishi Denki Kabushiki Kaisha, Tokyo, Japan

[21] Appl. No.: 627,548

[22] Filed: Jul. 3, 1984

[30] Foreign Application Priority Data

Jul. 20, 1983 [JP] Japan ..... 58-113823[U]

[51] Int. Cl.[4] ..... F02N 15/06

[52] U.S. Cl. ..... 74/7 E; 74/7 A; 74/801; 310/83

[58] Field of Search ..... 74/7 R, 7 A, 7 C, 7 E, 74/801; 290/38 C, DIG. 1; 310/83, 99

[56] References Cited

U.S. PATENT DOCUMENTS

| | | | |
|---|---|---|---|
| 2,578,094 | 12/1951 | Sears | 74/7 A |
| 3,153,158 | 10/1964 | Schmitter | 310/83 |
| 3,771,372 | 11/1973 | Asahi et al. | 74/7 R |
| 3,851,532 | 12/1974 | Pfluger et al. | 74/7 A |
| 4,454,437 | 6/1984 | Tanaka et al. | 310/83 |
| 4,507,978 | 4/1985 | Tanaka et al. | 74/7 E |

FOREIGN PATENT DOCUMENTS

| | | | |
|---|---|---|---|
| 3042436 | 6/1982 | Fed. Rep. of Germany . | |
| 242601 | 9/1925 | United Kingdom | 310/83 |
| 994887 | 6/1965 | United Kingdom . | |

OTHER PUBLICATIONS

Abstract 3-8-55 of U.S. Pat. No. 2,703,847 Filed 11-24-53 and Titled Driving Mechanism for Starter-Generator, Kalikow.

*Primary Examiner*—Allan D. Herrmann

*Attorney, Agent, or Firm*—Oblon, Fisher, Spivak, McClelland & Maier

[57] ABSTRACT

The internal speed-reduction type starter comprises a cylindrical armature rotary shaft, a pinion shaft inserted into the cylindrical rotary shaft, an epicyclic reduction gear and an overrunning clutch, placed in the rear of the armature, which connects the rotary shaft with the pinion shaft, an electromagnetic device for causing the pinion shaft to slide in its axial direction to actuate an internal combustion engine.

3 Claims, 3 Drawing Figures

FIGURE 1 *PRIOR ART*
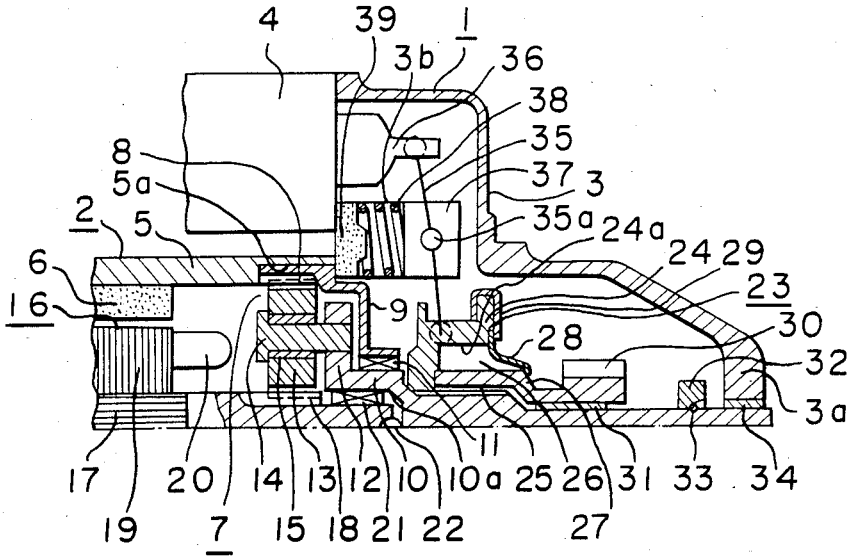
FIGURE 3
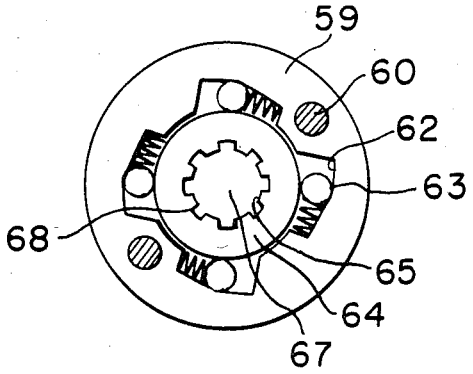

INTERNAL SPEED-REDUCTION TYPE STARTER

BACKGROUND OF THE INVENTION

1. Field of the Invention

The present invention relates to an improvement in an internal speed-reduction type starter equipped with an epicyclic reduction gear.

2. Discussion of the Background

FIG. 1 shows as an example a conventional internal speed-recution type starter 1. In FIG. 1, a reference numeral 2 designates a d.c. motor, a numeral 3 designates a front bracket supporting the d.c. motor by means of long bolts (not shown in drawing), a numeral 4 designates an electromechanical switching means, typically a solenoid, attached to the front bracket and a numeral 5 designates the yoke of the d.c. motor 2 onto the inner surface of which magnetic field poles 6 formed of ferrite permanent magnet are fixed. In the inner circumferential surface of the front end portion of the yoke 5, a circular seat portion 5*a* is formed and a ring gear 8 as a structural element of an epicyclic reduction gear 7 is fitted to the circular seat portion 5*a*. The ring gear 8 is firmly attached with a flange 9 which is supported through a sleeve bearing 11 by a pinion shaft 10 as an output rotary shaft of the epicyclic reduction gear 7. A flange 12 is firmly attached to or formed integrally with an end portion of the pinion shaft 10. A supporting pin 14 is set up on the side surface of the flange 12 to have a function as an arm for pivotally supporting a planet gear 13 through a sleeve bearing 15.

An armature 16 is secured on an armature rotary shaft 17 which is provided with a spur gear 18 at its front end portion with which the planet gear 13 is always interlocked to be driven. A reference numeral 19 designates an armature iron core and a numeral 20 designates an armature winding. A sleeve bearing 21 is fitted to an annular space formed between the outer peripheral surface at the front end of the armature rotary shaft 17 and inner peripheral surface of a recess 10*a* formed in the rear end of the pinion shaft 10 so as to support the front end of the shaft 17 in a freely rotatable manner. A steel ball 22 is provided between the rear end of the pinion shaft 10 and the front end of the armature rotary shaft 17 to bear thrust of the both shafts. An overrunning clutch 23 comprises a clutch outer member 24 which is connected to the pinion shaft 10 so as to be slidable in the axial direction of the pinion shaft 10 through a helical spline 25 formed in the outer surface of the pinion shaft 10. A frictional roller 26 is placed in a wedge-like space formed between the clutch inner member 27 and a cam surface 24*a* formed on the inner circumferential surface of the clutch outer member 24, the frictional roller 26 being engaged with the narrow area of the wedge-like space. A washer 28 is secured to the clutch outer member 24 by caulking of a cover 29 to assemble structural elements of the overrunning clutch 23 as shown in FIG. 1. A pinion 30 is fixed to the front end of the clutch inner member 27. A sleeve bearing 31 is fitted between the pinion shaft 10 and the inner peripheral surface of the pinion 30 so that the pinion 30 is slidable on and along the pinion shaft 10 in its axial direction. A stopper 32 is secured to the pinion shaft 10 by means of a ring 33 to act as a detent for preventing the overrunning clutch 23 from its forward projection. A sleeve bearing 34 is fitted to a projecting part 3*a* of the front bracket 3 to support the front end of the pinion shaft 10 in a freely rotatable manner. There is placed a shift lever 35 having one end connected to the clutch outer member 24 of the overrunning clutch 23 through a cam-engagement and the other end (the upper end) connected to a plunger 36 of solenoid 4 through a cam-engagement. The shift lever 35 is turned around a turnable fulcrum point 35*a* by actuating the plunger 36. A holder 37 supporting the turnable fulcrum point 35*a* of the shift lever 35 is loosely fitted in a recess 3*b* of the front bracket 3 so as to be movable in the axial direction. A force applied to the holder 37 to support the shift lever 35 is received by the front bracket 3. A lever spring 38 is placed in the recess 3*b* to urge the holder 37 towards the inner surface of the front bracket 3*a*. A grommet 39 is placed to receive a repulsive force of the lever spring 38.

Operations of the conventional starter having the construction as above-mentioned will be described.

Actuation of the electromagnetic switch 4 causes operations of structural elements of the starter as follows: the plunger 36 is attracted into a casing (in the left direction in drawing); the shift lever 35 is turned around the turnable fulcrum point 35*a* in the counterclockwise direction; the overrunning clutch 23 is moved fowardly (in the right direction) along the pinion shaft 10; the front end of the pinion 30 comes in contact with the stopper 32 and the pinion 30 is brought to interlocked with a ring gear (not shown) of an internal combustion engine although it is not shown in the drawing.

While the operations as above-mentioned are effected, the main contact (not shown) of the solenoid switch 4 is closed by the actuation of the plunger 36. Then, the armature 16 is connected to a d.c. power source (which may be a battery) through the main contact whereby there takes place a torque in the armature rotary shaft 17 due to excitation of magnetic poles 6. When the rotational force is applied to a planet gear 13 through the spur gear 18 formed on the armature rotary shaft 17, the planet gear 13 rolls around the rotary shaft 17 while interlocking with teeth formed inside the ring gear 8 to thereby increase a torque by speed-reducing function of the epicyclic reduction gear 7. The rotational force is transmitted to the pinion shaft 10 so that the ring gear for effecting initiation of the internal combustion engine is driven by the pinion shaft 10 through the helical spline 25, the clutch outer member 24, the cam surface 24*a*, the frictional roller 26, the clutch inner member 27 and the pinion 30. After the internal combustion engine is started, the pinion 30 is driven at an excessive speed by the ring gear. A rotational force caused by the excessive revolution, namely reversely driving force makes a relative rotation between the cam surface 24*a* and the clutch inner member 27 to be opposite whereby the frictional roller 26 disconnects the clutch inner member 27 from the clutch outer member 24. Then, only the pinion 30 rotates along with the ring gear for effecting initiation of the engine to release the rotational force caused by the excessive revolution applied to the structural elements preceeding the overrunning clutch 23. When the solenoid 4 is deenergized, the plunger 36 is moved in the right direction by the action of a coil spring held in the casing and it returns at a position as shown in FIG. 1, with the result that the overrunning clutch 23 is retracted to disconnect the pinion 30 from the ring gear (not shown).

Thus, in the conventional device, the two rotary shafts 10, 17 are separately disposed in the axial direction and supporting structure for each of the rotary shafts is complicated and accordingly, it is disadvantageous that the circular seat portion 5*a* is apt to be bent and it is difficult to for the structural elements to have mechanical strength in view of restriction in structure.

SUMMARY OF THE INVENTION

It is an object of the present invention to eliminate the disadvantage of the conventional starter and to provide an internal speed-reduction type starter having excellent effect by disposing a single rotary shaft extending from the front bracket to the rear bracket and fixing a pinion on to the rotary shaft so that the pinion is forwardly moved integrally with the rotary shaft.

The foregoing and the other objects of the present invention have been attained by providing an internal speed-reduction type starter which comprises an armature placed at the inner circumferential side of a stator so as to be rotatable, an armature rotary shaft of a cylindrical form which is fitted to the revolution center part of the armature, a reduction gear device driven at a reduced speed by a gear formed at one end of the armature rotary shaft, an overrunning clutch comprising a first connecting member driven by a rotating member at the output side of the reduction gear device and a second connecting member which allows one-way connection to the first connecting member, an output rotary shaft which passes through the cylindrical armature rotary shaft in a slidable manner in its axial direction to extend both sides of the rotary shaft and which is connected at its one end to the second connecting member of the overrunning clutch through a spline structure, a pinion placed at the other end of the output rotary shaft and an electromagnetic device for causing the pinion to move in the axial direction.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a longitudinally cross-sectional view showing an important part of the conventional starter;

FIG. 3 is a cross-sectional view taken along the line III—III in FIG. 2.

DETAILED DESCRIPTION OF THE PREFERRED EMBODIMENT

Figure 2:
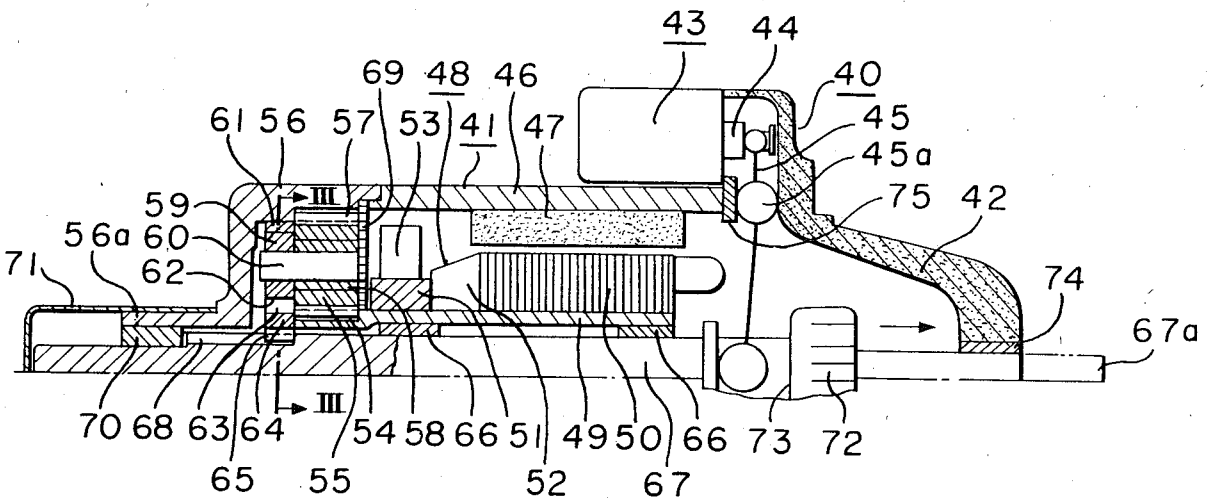
FIG. 2 is a longitudinal sectional view showing an upper half portion of an embodiment of the internal speed-reduction type starter according to the present invention.

An embodiment of the present invention will be described with reference to drawing.

In FIG. 2, a internal speed-reduction type starter 40 includes therein a d.c. motor 41, a front bracket 42, an electromechanical switching means 43, such as a solenoid a plunger 44 with which the upper end of a shift lever 45 is engaged by means of a cam, a yoke 46 and magnetic poles 47 fixed onto the inner peripheral surface of the yoke 46. An armature 48 is constituted by a rotary shaft 49 in a form of a hollowed cylinder, an armature core 50 fitted onto the rotary shaft 49, a commutator 51 and armature windings 52 which are fitted in slots (not shown) of the armature core 50 and leads connected to the commutator 51. Brushes 53 are in contact with the commutator 51. The spur gear 54 is formed on one end of the rotary shaft 49 to form a sun gear of an epicyclic reduction gear. A planet gear 55 is always interlocked with the spur gear 54 and it is also interlocked with an internal gear 57 formed in the inner circumferential surface of the a rear bracket 56. The planet gear 55 is rotatably supported through a sleeve bearing 58 by a supporting pin 60 fitted to a flange 59 which functions as an arm of the epicyclic reduction gear. A bearing 61 is fitted in a space between the outer circumferential surface of the flange 59 and the inner wall of the rear bracket 56. As clearly seen from FIG. 3 which is a cross-sectional view taken along III—III in FIG. 2, cam portions of the overrunning clutch are formed integrally with the flange 59 at its central portion. Each of frictional rollers 63 is placed in a space between a clutch inner member 64 and each of the cam portions 62 a spring being put in the space to push the roller. A helical spline 65 is formed in the inner circumferential surface of the clutch inner member 64. A helical spline 68 is formed in the outer circumferential surface of an output rotary shaft 67 which is inserted into a through hole of the cylindrical rotary shaft 49 and which is rotatably held and slidably moved in its axial direction by means of sleeve bearings 66. The clutch inner member 64 is connected to the output rotary shaft 67 by means of the helical splines 65 and 68. A washer 69 is disposed between the yoke 46 and the rear bracket 56. A sleeve bearing 70 is placed in a space between the inner pheripheral surface of a projecting portion 56*a* of the rear bracket 56 and the rear end of the output rotary shaft 67 so that the shaft 67 is slidable in its axial direction. A cover 71 covers the projecting portion of the rear bracket 56 and the rear end of the output rotary shaft 67. A pinion 72 is formed integrally with or firmly attached by means of a spline structure to the output rotary shaft 67 at the front bracket side. A groove 73 for cam engagement is formed at the rear side of the pinion 72 and engaged with the lower end of the shift lever 45 through a cam engagement. A sleeve bearing 74 for supporting the front end of the output rotary shaft 67 so as to be slidable in its axial direction is fitted at the front end portion of the front bracket 42. A grommet 75 is placed to support a fulcrum point 45*a* of the shift lever 45.

Operations of the embodiment of the present invention having the construction as above-mentioned will be described.

On actuation of the solenoid 43, the plunger 44 is attracted into the casing and the shift lever 45 is turned around the turnable fulcrum point 45*a* in the counterclockwise direction, with the result that the output rotary shaft 67 is forwardly moved to the position 67*a* as shown by a chain line. The forward movement of the output rotary shaft 67 causes the pinion 72 to be interlocked with the ring gear of the internal combustion engine (not shown). After this, a power source voltage is applied to the brushes 53 to actuate the armature 48 of the d.c. motor 41 by feeding current to thereby generate a rotational force. The rotational force is transmitted to the planet gear 55 through the spur gear 54 and the revolution of the armature 48 is reduced by the epicyclic reduction gear. The flange 59 is driven at a reduced speed. The rotational force given to the flange 59 is transmitted through power transmitting means consisting of the cam portions 62, the frictional rollers 63, the clutch inner member 64, and the helical splines 65, 68 to the output rotary shaft 67 whereby the internal combustion engine is started by the pinion 72 fixed on the output rotary shaft 67. After the internal combustion engine is started, a rotational force caused by an excessive revolution is transmitted from the ring gear (not shown) through the pinion 72 to the output rotary shaft 67. However, one-way rotational force transmitting function of the frictional rollers 63 prevents excessive-driving of the epicyclic reduction gear as described before.

Thus, in accordance with the present invention, an output rotary shaft acting as a pinion shaft is inserted in a hollow cylindrical armature rotary shaft and the output rotary shaft is connected to an epicyclic reduction gear provided at the rear side of an armature through a helical spline structure so that the pinion shaft is moved forwardly to start an internal combustion engine. The structure of the present invention allows use of a single rotary shaft extending from the front bracket to the rear bracket with both ends rotatably supported, whereby the mechanical strength of the device increases and the entire structure of the device is made compact.

Obviously, numerous modifications and variations of the present invention are possible in light of the above teachings. It is therefore to be understood that within the scope of the appended claims, the invention may be practiced otherwise than as specifically described herein.

I claim:

1. An internal speed-reduction type starter which comprises:

(a) an armature placed at the inner circumferential side of a stator so as to be rotatable, (b) an armature rotary shaft of a cylindrical form which is fitted to the revolution center part of said armature, (c) a reduction gear device driven at a reduced speed by a gear formed at one end of said armature rotary shaft, (d) an overrunning clutch comprising a first connecting member driven by a rotating part at the output side of said reduction gear device and a second connecting member which allows one-way connection to said first connecting member, (e) an output rotary shaft which passes through said cylindrical armature rotary shaft in a slidable manner in its axial direction to extend from both sides of said armature rotary shaft and which is connected at its one end to said second connecting member of said overrunning clutch through a spline structure, (f) a pinion placed at the other end of said output rotary shaft, and, (g) an electromagnetic device for causing said pinion to move in the axial direction.

2. The starter according to claim 1, wherein both ends of said output rotary shaft are supported by brackets fixed to both sides of said starter.

3. The starter according to claim 1, wherein said reduction gear device is an epicyclic reduction gear.

* * * * *